US011649603B2

(12) United States Patent
Friesen

(10) Patent No.: US 11,649,603 B2
(45) Date of Patent: May 16, 2023

(54) MANHOLE REHABILITATION SYSTEM

(71) Applicant: Predl Systems North America Inc., Burnaby (CA)

(72) Inventor: Jed Christopher Friesen, Vancouver (CA)

(73) Assignee: GENEVA PIPE AND PRECAST COMPANY, Vancouver, WA (US)

( * ) Notice: Subject to any disclaimer, the term of this patent is extended or adjusted under 35 U.S.C. 154(b) by 0 days.

(21) Appl. No.: 17/221,684

(22) Filed: Apr. 2, 2021

(65) Prior Publication Data

US 2021/0292991 A1 Sep. 23, 2021

Related U.S. Application Data

(63) Continuation of application No. 16/690,027, filed on Nov. 20, 2019, now Pat. No. 10,968,594.

(60) Provisional application No. 62/770,028, filed on Nov. 20, 2018.

(51) Int. Cl.
*E02D 29/12* (2006.01)

(52) U.S. Cl.
CPC ..... *E02D 29/128* (2013.01); *E02D 29/125* (2013.01); *E02D 2250/0023* (2013.01)

(58) Field of Classification Search
CPC ..... E02D 29/125; E02D 29/128; E02D 2250/0023; E02D 29/124; E03F 5/021; E03F 5/025; E03F 5/027; E03F 5/02
See application file for complete search history.

(56) References Cited

U.S. PATENT DOCUMENTS 541,987 A 7/1895 Whiteside
1,712,510 A * 5/1929 Monie ..... E02D 29/12 182/90
1,955,018 A 4/1934 Rego
2,025,839 A 12/1935 Woods
2,030,536 A 2/1936 Rego
2,239,033 A 4/1941 Cartmill
(Continued)

FOREIGN PATENT DOCUMENTS

DE 817419 C 10/1951
EP 0685607 A1 12/1995
(Continued)

OTHER PUBLICATIONS

Fernco Inc., "Fernco Saddle", https://www.google.ca/search?q=fernco+saddle&client=safari&hl=en-ca&prmd=sivn&source=Inms&tbm=isch&sa=X&ved=2ahUKEwibgZ2dhPLkAhXWsJ4KHaosDjkQ_AUoAnoECA4QAg&biw=375&bih=635&dpr=3, accessed Sep. 27, 2019, 3 pages.
(Continued)

*Primary Examiner* — Carib A Oquendo
(74) *Attorney, Agent, or Firm* — Egbert, McDaniel & Swartz, PLLC

(57) ABSTRACT

A manhole rehabilitation system where in one example an existing cross-pipe is exposed and a manhole base and riser are cast around and above the existing cross pipe to form a manhole. In one example an FRP base liner and FRP riser liner are placed before casting in place. In one example casting is made of an aggregate. In one example, a collar and manhole cap rest upon the casting, and are supported thereby such that the liner need not be structural. In one example an existing pipe or manhole forms the outer surface of the casting. In one example shoring is placed and used as the outer surface of the casting.

11 Claims, 5 Drawing Sheets

(56) References Cited

U.S. PATENT DOCUMENTS

| | | | | |
|---|---|---|---|---|
| 2,254,668 | A | 9/1941 | Tomek | |
| 2,620,749 | A | 12/1952 | West | |
| 2,681,494 | A | 6/1954 | Weber | |
| 2,689,687 | A | 9/1954 | Zorislav | |
| 3,090,160 | A | 5/1963 | Shaver et al. | |
| 3,321,884 | A | 5/1967 | Hermann | |
| 3,331,295 | A | 7/1967 | Sorrell | |
| 3,370,386 | A | 2/1968 | Martin | |
| 3,462,896 | A | 8/1969 | Lokensgaard | |
| 3,477,106 | A | 11/1969 | Tetzlaff et al. | |
| 3,533,199 | A | 10/1970 | Pickett | |
| 3,715,958 | A | 2/1973 | Crawford et al. | |
| 3,745,738 | A * | 7/1973 | Singer | E02D 29/12 264/34 |
| 3,787,078 | A | 1/1974 | Williams | |
| 3,938,285 | A | 2/1976 | Gilbu | |
| 3,965,233 | A | 6/1976 | Ritter | |
| 4,030,694 | A | 6/1977 | Schimmel | |
| RE29,636 | E * | 5/1978 | Gilbu | E02D 29/12 52/309.1 |
| 4,102,088 | A | 7/1978 | Keller et al. | |
| 4,119,291 | A * | 10/1978 | Polito | E02D 29/12 249/11 |
| 4,123,033 | A | 10/1978 | Joelson | |
| 4,127,990 | A | 12/1978 | Morrow | |
| 4,275,757 | A | 6/1981 | Singer | |
| 4,318,880 | A * | 3/1982 | McIntosh | E03F 5/021 249/153 |
| 4,346,921 | A | 8/1982 | Gill et al. | |
| 4,372,017 | A | 2/1983 | Heckethorn | |
| 4,419,231 | A | 12/1983 | Friedl | |
| 4,422,994 | A * | 12/1983 | Ditcher | E03F 5/021 264/219 |
| 4,472,911 | A | 9/1984 | Jooris et al. | |
| 4,591,290 | A | 5/1986 | Prescott | |
| 4,621,941 | A | 11/1986 | Ditcher et al. | |
| 4,682,907 | A | 7/1987 | Gaudin | |
| 4,751,799 | A | 6/1988 | Ditcher et al. | |
| 4,776,138 | A | 10/1988 | Sumner et al. | |
| 4,776,722 | A | 10/1988 | Gaudin | |
| 4,927,290 | A | 5/1990 | Bowman | |
| 5,017,313 | A | 5/1991 | Trimble | |
| 5,032,197 | A | 7/1991 | Trimble | |
| 5,081,802 | A | 1/1992 | Westhoff et al. | |
| 5,100,697 | A | 3/1992 | Nielsen | |
| 5,261,766 | A | 11/1993 | Anderson | |
| 5,263,298 | A | 11/1993 | Ballesteros | |
| 5,271,518 | A | 12/1993 | Webb | |
| 5,303,518 | A | 4/1994 | Strickland | |
| 5,308,192 | A * | 5/1994 | Srackangast | F16L 25/12 405/303 |
| 5,360,131 | A | 11/1994 | Phillipps et al. | |
| 5,386,669 | A | 2/1995 | Almeida | |
| 5,413,307 | A | 5/1995 | Tidwell | |
| 5,451,081 | A | 9/1995 | Kaucnik | |
| 5,536,420 | A | 7/1996 | Oyzboyd | |
| 5,549,411 | A | 8/1996 | Hawkins | |
| 5,564,860 | A | 10/1996 | Amann | |
| 5,735,082 | A | 4/1998 | Lecuyer et al. | |
| 5,885,446 | A | 3/1999 | McGrew, Jr. | |
| 5,979,117 | A | 11/1999 | Fuller | |
| 6,074,130 | A | 6/2000 | Duran | |
| 6,135,141 | A | 10/2000 | Bombach | |
| 6,202,370 | B1 | 3/2001 | Miller et al. | |
| 6,266,928 | B1 | 7/2001 | Argandona | |
| 6,385,913 | B1 | 5/2002 | Ahn | |
| 6,393,771 | B1 | 5/2002 | Stetson | |
| 6,428,701 | B1 | 8/2002 | Mullennix et al. | |
| 6,457,901 | B1 | 10/2002 | Sondrup | |
| 6,613,228 | B2 | 9/2003 | Petersen et al. | |
| 6,746,178 | B1 | 6/2004 | Hensley et al. | |
| 6,851,225 | B1 | 2/2005 | Haar et al. | |
| 7,144,189 | B1 | 12/2006 | Bongiovanni et al. | |
| 7,347,644 | B2 | 3/2008 | Meyers | |
| 7,473,373 | B1 | 1/2009 | Danler | |
| 7,695,213 | B1 | 4/2010 | Akkala et al. | |
| 7,748,926 | B2 | 7/2010 | Jurich et al. | |
| 8,479,469 | B2 | 7/2013 | Ciccarelli | |
| 8,851,789 | B2 | 10/2014 | Bax | |
| 9,011,035 | B2 | 4/2015 | Munro | |
| 9,175,705 | B1 | 11/2015 | Clark, Jr. et al. | |
| 9,890,513 | B1 | 2/2018 | Wu et al. | |
| 10,022,825 | B2 | 8/2018 | Crispin | |
| 10,138,615 | B2 | 11/2018 | Kim et al. | |
| 10,214,893 | B2 | 2/2019 | Skinner et al. | |
| 10,294,627 | B2 | 5/2019 | Bechler et al. | |
| 10,344,447 | B2 | 7/2019 | Sauve et al. | |
| 10,370,181 | B1 | 8/2019 | Plummer | |
| 10,428,548 | B2 | 10/2019 | Yano | |
| 10,436,374 | B2 | 10/2019 | Kiest, Jr. | |
| 10,442,617 | B1 | 10/2019 | Holbrook | |
| 10,458,093 | B2 | 10/2019 | Gilbert | |
| 10,563,373 | B1 | 2/2020 | Friesen | |
| 10,662,606 | B1 | 5/2020 | Friesen | |
| 10,689,834 | B2 | 6/2020 | Levesque | |
| 10,822,766 | B1 | 11/2020 | Friesen | |
| 10,961,681 | B2 | 3/2021 | Friesen | |
| 10,968,594 | B1 | 4/2021 | Friesen | |
| 2004/0081517 | A1 | 4/2004 | Hartman | |
| 2005/0000175 | A1 | 1/2005 | Machledt et al. | |
| 2005/0100412 | A1 | 5/2005 | Houck | |
| 2006/0065994 | A1 | 3/2006 | Zotto | |
| 2007/0053747 | A1 | 3/2007 | O'Brien | |
| 2011/0013991 | A1 | 1/2011 | Watson et al. | |
| 2011/0203192 | A1 | 8/2011 | Schneider et al. | |
| 2012/0141210 | A1 | 6/2012 | Kiest, Jr. | |
| 2012/0159883 | A1 | 6/2012 | Dayton | |
| 2012/0233950 | A1 | 9/2012 | Carr et al. | |
| 2013/0336723 | A1 | 12/2013 | McKinney et al. | |
| 2016/0097180 | A1 | 4/2016 | Pesonen | |
| 2016/0145848 | A1 | 5/2016 | Skinner et al. | |
| 2017/0107714 | A1 | 4/2017 | Connell | |
| 2017/0369236 | A1 | 12/2017 | Goad | |
| 2018/0305888 | A1 | 10/2018 | Bonell et al. | |
| 2019/0145091 | A1 | 5/2019 | Skinner et al. | |
| 2020/0217037 | A1 | 7/2020 | Friesen | |
| 2020/0399913 | A1 | 12/2020 | Amend | |

FOREIGN PATENT DOCUMENTS

| | | | |
|---|---|---|---|
| EP | 0737617 | A1 | 10/1996 |
| EP | 2604758 | B1 | 4/2014 |
| FR | 2897378 | B1 | 4/2008 |
| GB | 2145444 | B | 4/1988 |
| JP | 0726408 | A | 3/1995 |
| JP | 408333763 | A | 12/1996 |
| JP | 2006090047 | A | 4/2006 |
| JP | 2014077249 | A | 5/2014 |
| JP | 2016145484 | A | 8/2016 |
| JP | 2017197941 | A | 11/2017 |
| WO | 2018011812 | A1 | 1/2018 |

OTHER PUBLICATIONS

Hobas, "Hobas Tee Manhole", https://www.google.ca/search?q=hobas+tee+manhole&client=safari&hl=en-ca&prmd=isnv&source=Inms&tbm=isch&sa=X&ved=2ahUKEwiR19vEhPLkAhUNvp4KHTVFBpYQ_AUoAXoECAsQAQ&biw=375&bih=635, accessed Sep. 27, 2019, 9 pages.

National Liner, "The 3S Segment Panel System: for the structural rehabilitation and restoration of storm sewers, sanitary sewers, sanitary sewers and culverts", https://www.nationalliner.com/portals/0/pdf/3-pannel-system.pdf, accessed Nov. 5, 2019, 4 pages.

National Precast Concrete Association, "Watertight Manhole Joints," Jun. 2013, 4 pages.

* cited by examiner

MANHOLE REHABILITATION SYSTEM

RELATED APPLICATIONS

This application claims priority benefit of and is a Continuation of U.S. Ser. No. 16/690,027 filed Nov. 20, 2019, which claims priority benefit of U.S. Provisional Ser. No. 62/770,028 filed Nov. 20, 2018, each incorporated herein by reference.

BACKGROUND OF THE DISCLOSURE

Field of the Disclosure

This disclosure relates to the field of manhole assemblies forming a chamber allowing access to a cross pipe. The disclosure includes a method and apparatus for reinforcing and improving an existing manhole structure in place.

RELATED APPLICATIONS

U.S. patent application Ser. No. 15/946,643 ('643) discloses a different manhole assembly, which is manufactured off site in sections, and then assembled on site. The base of the '643 application comprises bell connectors or equivalents which are attached to pipes which terminate at the bell connectors.

BRIEF SUMMARY OF THE DISCLOSURE

Disclosed herein is a method for producing a manhole. In one example the method comprises the steps of:

- establishing an excavation below a ground level;
- exposing external piping in the excavation;
- removing a section of the external piping;
- providing a non-structural base liner having surfaces defining pipe openings, an outer surface, an upper edge;
- placing the base liner in the excavation, the laterally opposed pipe openings aligned with the external piping;
- placing a channel pipe having opposing ends in the base liner, attaching the opposing ends of the channel pipe to the external piping in place of the removed section; wherein the channel pipe passes through the pipe openings;
- the channel pipe having an open channel in the upper region thereof, the open channel forming a fluid conduit to the external piping;
- placing a channel form/plug in the open channel, substantially sealing the open channel from entry of debris;
- filling the base liner with a semi-fluid aggregate material such as concrete, grout, plaster, resin, etc.;
- substantially surrounding the base liner with the semi-fluid aggregate material;
- allowing the aggregate material to harden;
- removing the channel form/plug;
- sealing at least one riser liner to the upper edge of the base liner;
- sealing a cone liner to an upper edge of the riser liner;
- sealing a riser cap to the upper edge of the riser cone; and
- disposing a volume of aggregate fill exterior of the base liner, riser liner, and cone liner.

The steps disclosed above in some applications is not dependent on the order presented above. Not all steps are required in all applications, nor is the method of installation limited to the order above. The external piping may be linear or non-linear.

The method may be implemented wherein the channel pipe is formed of a polymer such as HDPE (High-density polyethylene), ABS (acrylonitrile butadiene styrene), uPVC (unplasticized polyvinyl chloride), CPVC (post chlorinated polyvinyl chloride), PB-1 (polybutylene), PP (polypropylene), PE (polyethylene), 4.8 PVDF (polyvinylidene fluoride), uPVC (unplasticized polyvinyl chloride) Variants, PE RT (polyethylene resin), and equivalents.

The method may be implemented wherein the open channel is open greater than 90°, 140°, 170°, or 180° around the circumference of the channel pipe.

The method may be implemented wherein the channel plug is sacrificial. This meaning that the channel plug is destroyed when it is removed and not able to be used again.

The method may be implemented wherein the step of filling the base liner includes the step of filling the base liner up to an upper edge of the channel pipe.

The method may be implemented wherein the base liner, riser liner, and/or cone liner are formed of, or comprise FRP. The term FRP as used herein to include fiber reinforced plastic materials. Examples of which are given later in this disclosure.

The method may be implemented wherein the base liner, riser liner, and/or cone liner are non-structural. The term "non-structural" used in this context that the components do not provide sufficient support for the manhole, nor satisfy compression requirements of the manhole. Sufficient support and compression requirements of the manhole are satisfied by the aggregate fill once hardened. A manhole ring, and manhole cover supported by the hardened state aggregate fill, not the base liner, riser liner, nor cone liner.

DETAILED DESCRIPTION OF THE DISCLOSURE

In the field of manholes great advances have been made over the past 1700 years to improve efficiency, reduce problems, reduce leakage into and out of sewer systems, and to improve the longevity of sewer systems.

Historically, a great number of manholes and other in-ground fluid conduits have been installed which deteriorate, have deteriorated, or are prone to leakage and failure. In many instances, it is required that these problematic manholes need to be repaired or replaced. Often the cost of replacement of such structures less than the cost of repair over time. Disclosed herein is a manhole rehabilitation system which may be utilized in several examples to provide a modern manhole where required. In some instances, the disclosed manhole rehabilitation system may be utilized interior of an existing manhole. In some instances, the disclosed manhole rehabilitation system may entirely replace existing manhole wherein the existing cross pipe is not entirely replaced. The cross pipe(s) commonly including at least one inlet pipe and at least one outlet pipe.

The term "manhole" used in this disclosure generally refers to a chamber extending from a cross pipe or conduit generally upward to a ground level. Commonly a manhole as the term is used in this disclosure comprises a base engaging a cross-pipe or cross pipes, a riser extending upward from the base, and a manhole cover. These components may be separate, or a unitary monolithic structure. The manhole cover or lid is commonly removable from the riser and allows access to the chamber. In many instances the chamber is large enough to fit an adult person may then enter the manhole to access the cross pipe for inspection, cleaning, or repair. Wherein the manhole cover is the component normally seen by most people the term manhole has become synonymous with the manhole cover, but the distinction is intended herein between the components forming the chamber and the manhole cover.

Figure 1:
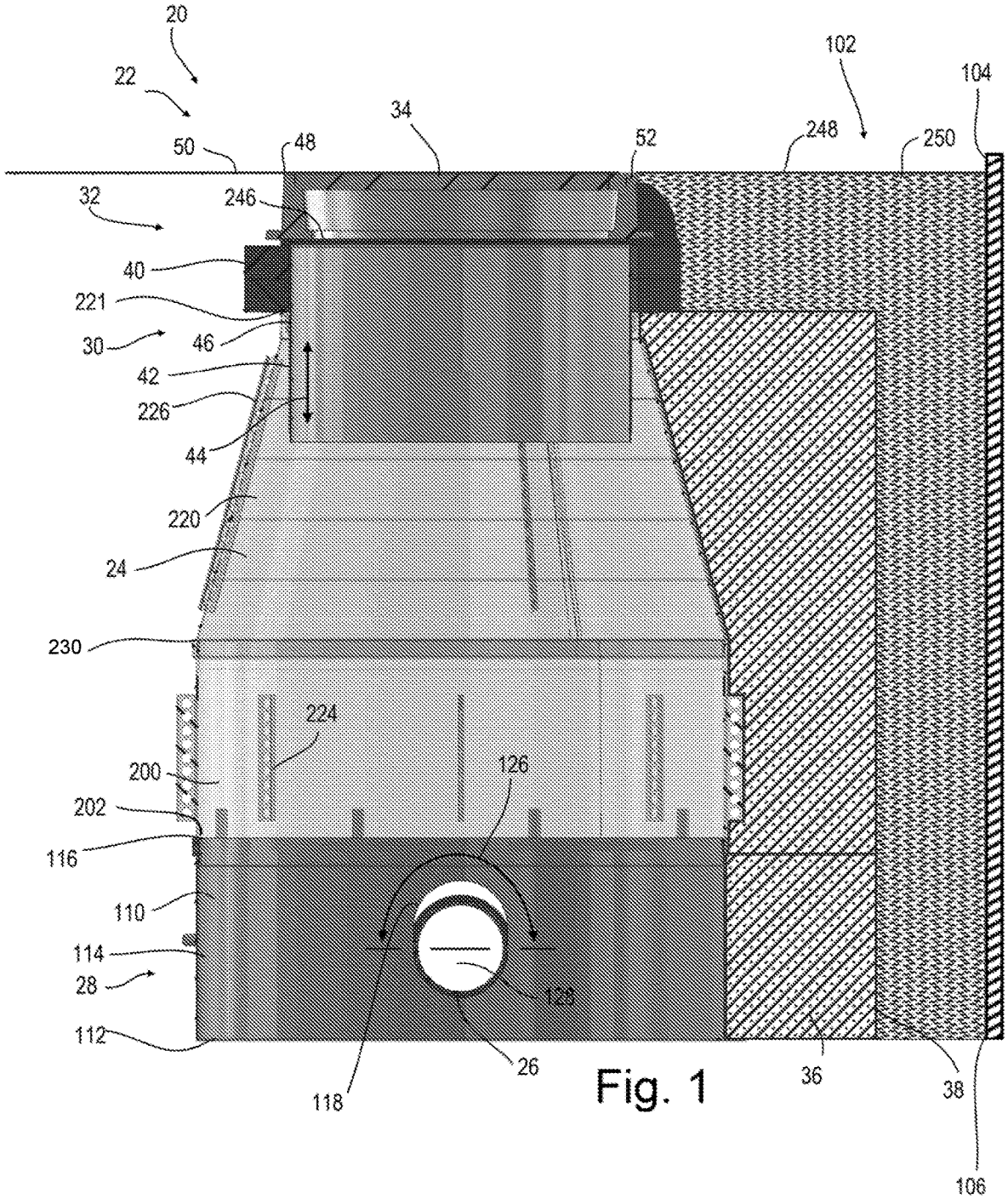
FIG. 1 is a front partial section view of one example of a completed manhole rehabilitation system.

Looking to FIG. 1 is shown one example of a manhole rehabilitation system 20. As shown, the disclosed manhole rehabilitation system 20 forms a manhole 22.

The manhole 22 of this example defines a chamber 24 which intersects a cross pipe 26 which may be in place prior to installation of the manhole 22. The chamber 24 of the manhole 22 is defined by several components, including a base 28 intersecting the pipe 26, a riser 30 extending upward from the base 28, and a riser cap 32 optionally including the previously mentioned manhole cover 34 removably fitted to the riser cap 32.

In FIG. 1 are shown several liner components with an aggregate fill 36 (grout) formed there around. The combination of the liner components, with the aggregate fill 36 and an optionally removable outer form 38 in combination form the base 28 and riser 30. Generally, the aggregate fill is poured into the space between the liner components and the outer form 38 and then hardens to a structural solid capable of supporting the weight of the manhole ring, manhole cover 34, and components such as vehicles etc. which may be temporarily supported by the manhole ring and manhole cover 34.

A more detailed description of the base 28, riser 30, and other components will follow a general description of the manhole rehabilitation system 20.

Once the aggregate fill 36 has hardened, the riser cap 32 and other components may be installed to the riser 20 and hardened aggregate material 36. This may be accomplished by attaching a plurality of blocks 40 or equivalent structural materials onto the top edge of the riser 30. These blocks 40 may be supported by the aggregate fill 36 and in turn support the cap 32 and cover 34. The blocks 40 may be hardened clay bricks, cinder blocks, pavers, or equivalent components. The riser cap 32 of the example shown having an outer surface 42 which prior to final installation of the aggregate 36 slides vertically 44 as the outer surface 42 of the riser cap 32 engages an optional gasket 46 on the top edge of the riser 30. In this way, the riser 32 may be adjusted such that the top edge 48 of the riser cap 32 is substantially flush or level with the ground level 50.

Thus, when installation is complete, the manhole cover 34 will also be substantially flush with the ground level 50. As previously mentioned, the liner components are generally not structural in that they will not satisfy structural requirements of manholes. This is especially relevant when the manhole 22 is below a roadway. Such installations are required to support a vehicle driving across the manhole cover 34. Thus, the aggregate fill 36, riser 32 including blocks 40 and manhole ring 52 provides structural resistance or compression strength to the manhole 22. In one example, the manhole ring 52 and manhole cover 34 are metallic such as cast iron, steel or other components well-known in the art of manholes.

Figure 2:
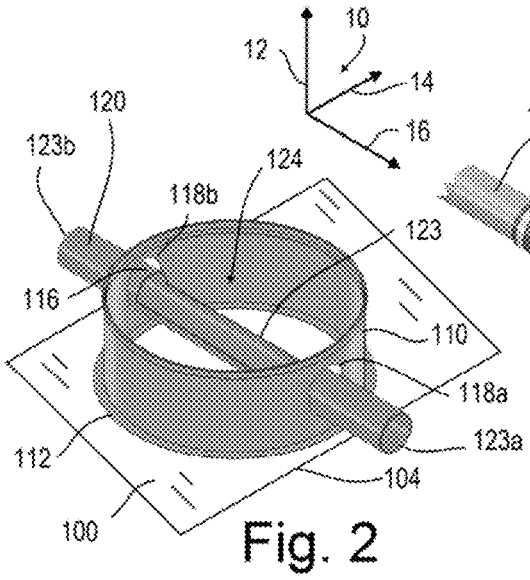
FIG. 2 is a top perspective view of an early (e.g. first) stage of construction of the manhole rehabilitation system.
Figure 3:
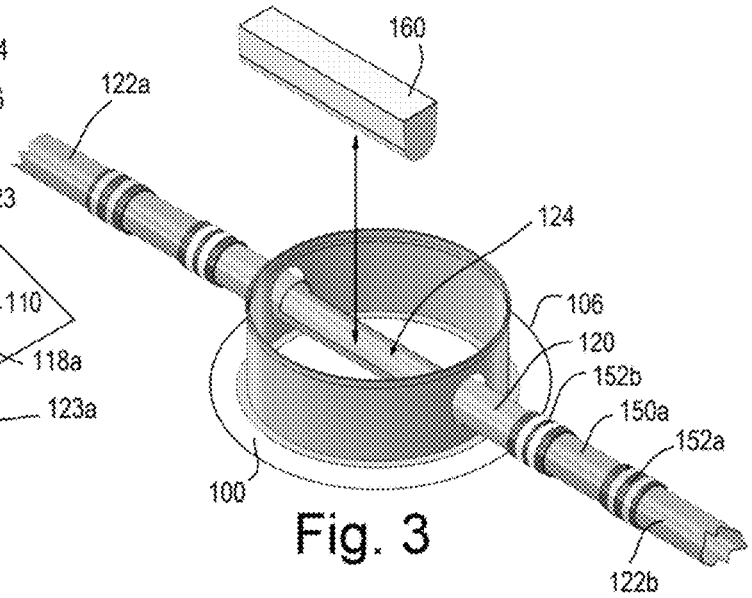
FIG. 3 is a top perspective view of another (e.g. second) stage of construction of the manhole rehabilitation system.

The other components are easily described by explaining one example of an assembly and construction process shown in FIG. 2-FIG. 16. FIG. 2 shows an excavation has been formed in the ground exposing a surface 100. The surface 100 may be an inner bottom surface of the excavation 102 or may be an equivalent surface such as the bottom of an existing manhole. In FIG. 2 is shown an example wherein the excavation 102 (see FIG. 1) comprises shoring 104 to maintain the shape of the excavation 102. In one example, the shoring 104 forms the outer surface of a mold into which the aggregate fill 36 is poured the form the structural (compression resisting) portion of the manhole 22. In the example shown in FIG. 3, an existing pipe or existing manhole 106 is utilized for the outer surface of the mold. FIG. 2 and FIG. 3 show examples of shoring 104 and optionally use of an existing manhole 106 as the outer surface of the mold. The shoring 104 and/or an existing manhole 106 are generally interchangeable and can be used for many examples of the manhole rehabilitation system 20 shown herein.

FIG. 2 also shows a base liner 110 having a bottom edge 112 resting upon the inner bottom surface 100. The base liner 110 of this example also has an outer surface 114 and an upper edge 116 vertically opposed to the bottom edge 112. As shown, there are one or more pipe openings 118 in the base liner 110 through which fluid flows into and out of the manhole 22. To differentiate specific pipe openings and specific examples of general components, a numbering system is used herein utilizing an alphabetic suffix for specific examples. In this example a pipe opening is labeled 118 wherein specific examples of the pipe openings 118 such as shown in FIG. 2 are labeled 118*a* and 118*b*.

Looking to FIG. 2 it can be seen that in this example a channel pipe 120 extends through both lateral sides of the base liner 110 through pipe openings 118. The channel pipe 120 of this example has ends 123 (123*a*, 123B) of the channel pipe 120 are exterior of the base liner 110. Also, it can be seen that a portion of the channel pipe 120 has been removed interior of the base liner 110, resulting in a surface 123 forming an upwardly open channel 124. The channel 124 allows the fluid in the channel pipe 120 to freely flow through the channel pipe 120 while still allowing visual inspection of the flow through the channel pipe 120 and inspection upstream and downstream of the channel 124. Looking to FIG. 3 it can be seen that the excavation 102 has exposed an external pipe 122 which has been cut and a section removed to install the base liner 110 and channel pipe 120. Cutting of the external pipe 122 and removal of a section thus forming separate external pipes 122*a* and 122*b*. In one example, the channel pipe 120 is cut to an angle 126 of approximately 180° relative to the longitudinal axis 128 of the channel pipe 120 to form the surface 123. In another example, the channel pipe 120 is cut to an angle 126 of greater than 170° relative to the longitudinal axis 128 of the channel pipe 120, forming the surface 123 of the channel 124.

The channel pipe 120 may then be connected to the external piping 122 through couplings which may include gaskets 152, seals, welding, brazing, etc. It is generally desired that the connection between the channel pipe 120 and external piping 122 not leak allowing fluid out of the channel pipe 120, nor cross pipes 122 into the surrounding ground. This sealing may be accomplished in many known methods. In FIG. 3 and subsequent Figs. a system is shown wherein a sleeve section 150 slides laterally onto the external piping 122 and the channel pipe 120 with a gasket 152 overlapping the sleeve section 150 and external piping 122 or sleeve section 150 and channel pipe 120.

Before continuing, and axes system 10 is disclosed herein as shown in FIG. 2. The axes system 10 comprising a vertical axis 12, a transverse axis 14 and a lateral axis 16. In addition, terminology is used where generic components use a numeric label, and specific components having similar structure may have alphabetic suffixes. For Example, gasket 152*a* is a specific gasket 152.

In one example, looking to FIG. 3, a channel form 160 is placed into the channel 124. The channel form 160 extending the length of the channel 124 and prohibiting aggregate fill or debris from entering into the channel 124 during the next stages of construction. In one example, the channel form 160 is formed of a malleable material to allow easy removal from the channel 124. In another example, the channel form 160 may be rigid with outer surfaces sufficiently smooth to allow easy removal from the channel 124 following hardening of the aggregate material poured their around and hardened. In one example, the channel form 160 is sacrificial. It may in this sacrificial example be made of foam or other materials which are destroyed when removed from the channel 124 during later steps of construction.

Figure 4:
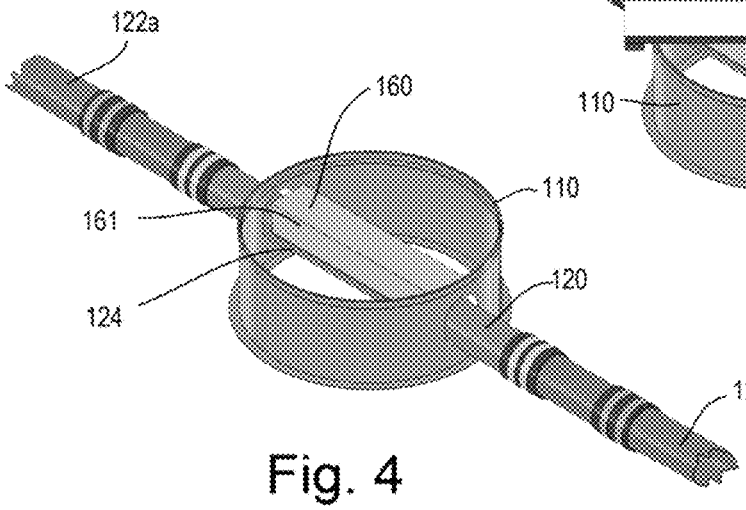
FIG. 4 is a top perspective view of another (e.g. third) stage of construction of the manhole rehabilitation system.

Looking to FIG. 4 is shown the channel form 160 placed into the open channel 124 ready for pouring of the aggregate fill into the base liner 110. At this stage, it may be desired to put adhesive tape, or other material upon the upper edge 116 of the base liner 110 to ensure that this surface does not become filled or damaged by the aggregate fill as the aggregate fill is poured into the base liner 110.

Figure 5:
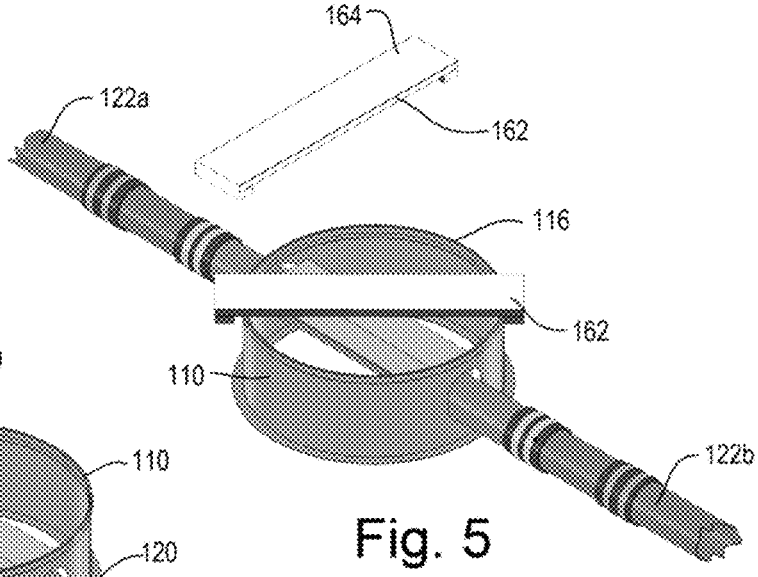
FIG. 5 is a top perspective view of another (e.g. fourth) stage of construction of the manhole rehabilitation system.

Looking to FIG. 5 is shown a worker support 162 which may be set upon the upper edge 116 of the base liner 110. In this position, a worker may stand upon the upper surface 164 of the worker support 162 as the aggregate fill is poured into the base liner 110 and smoothed, leveled, sloped, as beveled, or textured for a non-skid bench surface as desired.

Figure 6:
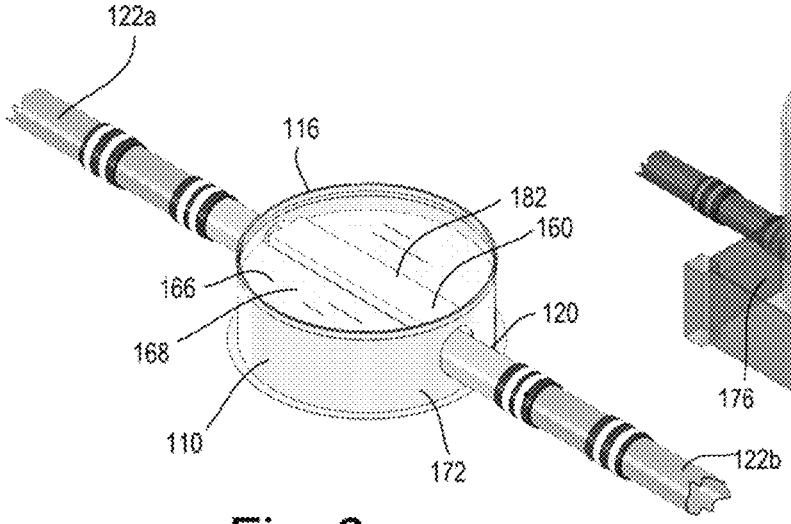
FIG. 6 is a top perspective view of another (e.g. fifth) stage of construction of the manhole rehabilitation system.

Looking to FIG. 6 can be seen that an aggregate fill 166 has been poured into the base liner 110. The aggregate fill 166 when hardened thus forming a bench 168 upon which a user may stand when inspecting or repairing the channel 124 and or cross pipes 122. Once the aggregate fill 166 has substantially hardened, the channel form 160 may be removed. The shape of the channel form 160 may enlarge the channel 124 as the surfaces of the aggregate fill 166 formed by the channel form 160 create a vertical or widened surface to the channel 124. In some examples, it may be desired to retain the channel form 160 in the channel 124 drain remaining steps of construction to keep debris out of the channel 124.

In one example, it may be desired to seal the benching surface 168 with a non-permeable and/or corrosive-resistant material to ensure that the aggregate fill 166 does not become permeated with deteriorating chemicals commonly found in sewage and groundwater. Such deteriorating chemicals may be present in the fluid flow through the channel 124, especially in sewage and industrial applications.

In one example, the aggregate material is a grout comprising 3250 PSI high flow non-shrink fast set grout known in the art for similar applications.

Figure 7:
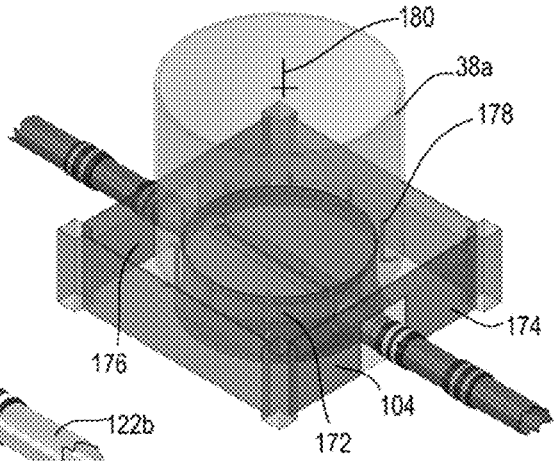
FIG. 7 is a top perspective view of another (e.g. sixth) stage of construction of the manhole rehabilitation system.

FIG. 7 shows another stage of construction wherein a volume of non-hardened aggregate 176 is placed between the outer surface 172 of the base liner 110 and a containing surface 174 which may be the interior surface of the excavation 102, the interior surface of shoring 104, or equivalent structure. Once the aggregate 176 is cured to a hardened state an outer mold 38*a* may be placed thereupon, radially outward of the upper edge 116 of the base liner 110 and resting upon the aggregate 176. In one example, alignment components 178 may be fitted to the aggregate 176 or other structure to align the outer mold 38*a* so as to have a center axis 180 on center with the center axis 182 of the base liner 110. In one form, the outer mold 38*a* is a cylinder such as sold under the trade name Sono Tube®.

Figure 8:
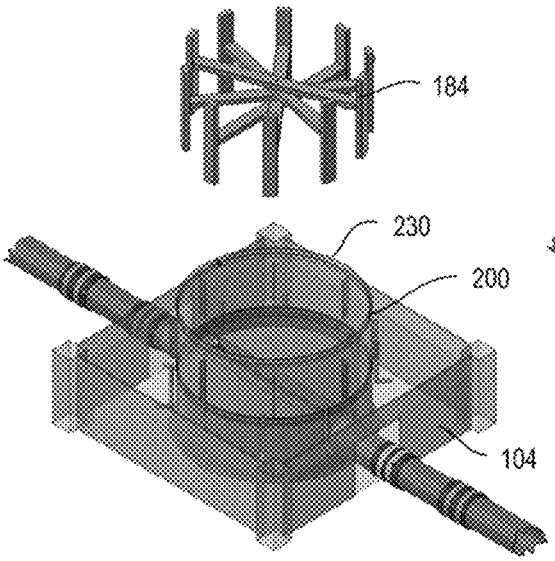
FIG. 8 is a top perspective view of another (e.g. seventh) stage of construction of the manhole rehabilitation system.
Figure 19:
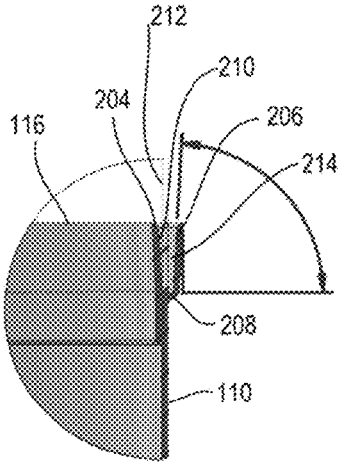
FIG. 19 is an enlarged view of the region 19 of FIG. 17.

Looking to FIG. 8 is shown another stage of construction which may be accomplished prior to installation of the outer mold 38*a* shown in FIG. 7. In FIG. 8 a pouring support 184 is positioned within the base liner 110 where the aggregate fill 166 as shown in FIG. 6 does not reach the upper edge 116 thus forming a lip contacting the pouring support 184. Once the pouring support 184 is in place, a riser liner 200 having a top edge 230 may be placed on the upper edge 116 of the base liner 110 and seal thereto. The riser liner 200 having an inner surface contacting the radially outward surface of the pouring support 184. The pouring supports 184 ensuring alignment of the riser liner 200 to the base liner 110. Sealing of the riser liner 200 to the base liner 110 may be accomplished by an O-ring, semi-fluid sealant, or hardening sealant such as well-known in the art. If an adhesive tape or similar component was used to protect the upper edge 116, this adhesive tape may be removed prior to installation of the riser 200. As shown in FIG. 1, it can be seen that the bottom 202 of the riser liner 200 and gauges the top edge 116 of the base liner 110. FIG. 19 shows a similar connection at an upper edge 116 of a base liner 110. In this example, the upper edge comprises an inner component 204 and an outer component 206 with a gap therebetween. The inner component 204 and the outer component 206 connect at a connection point 208. As shown, the bottom edge 210 of a second section 212 such as another riser section fits into the space between the inner component 204 and the outer component 206. A volume of sealant 214 may be disposed in the space so as to seal the base liner 110 to the second section 212. The second section 212 may be a riser liner 200, cone liner 220, or other component. Similarly other connections between other liner components/sections may be similarly constructed.

Figure 17:
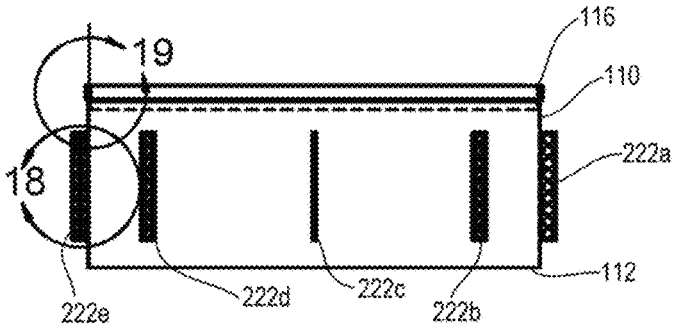
FIG. 17 is a side view of a riser liner component of the system shown in FIG. 1.
Figure 18:
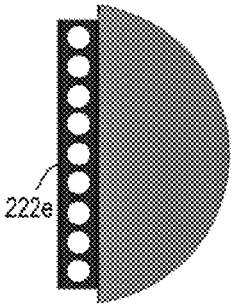
FIG. 18 is an enlarged view of the region 18 of FIG. 17.

FIG. 17 also shows a plurality of bridge anchors 222 (222*a*-222*d*) which further engage/mechanically bond the base liner 110 to the cured aggregate 176. Similar bridge anchors 224 may be fitted to the riser liner 200 for a similar purpose to mechanically bond the riser liner 200 to the aggregate fill 36. Similar bridge anchors 226 may be fitted to the cone liner 220 likewise to mechanically bond the cone liner 220 to the aggregate fill 36.

Although in the examples shown only one riser liner 200 is shown, it can be appreciated that a plurality of riser liners 200 may be connected/stacked one upon the other to extend the vertical height of the manhole 22 such that the distance between the surface 100 and the ground level 50 is achieved when the blocks 40, manhole ring 52 are included.

Figure 9:
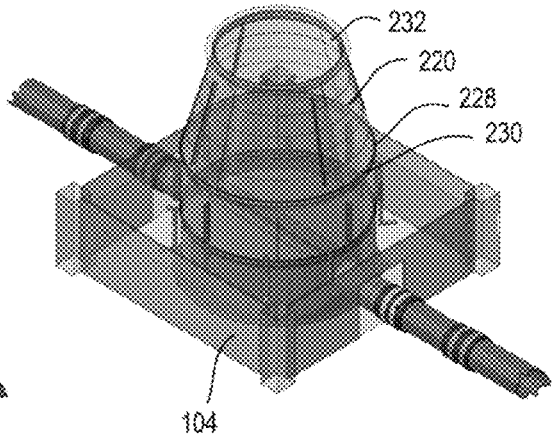
FIG. 9 is a top perspective view of another (e.g. eighth) stage of construction of the manhole rehabilitation system.
Figure 12:
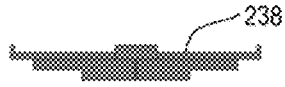
FIG. 12 is a side view of one component of the manhole rehabilitation system.

Looking to FIG. 9, the outer mold 30 8A is not fully shown in this Fig. to more clearly show the internal components. In FIG. 9, the bottom edge 228 of the cone liner 220 is shown fitted to the upper edge 230 of the riser liner 200. The cone liner 220 having an upper edge 221 which will connect to other sections in a later stage of assembly. This fitting of the cone liner 220 to the riser liner 200 may be accomplished in the same manner as that shown in FIG. 19 and disclosed above using the same or similar structures such as shown in FIG. 19.

In one example, the cone liner 220 has a first diameter at the bottom edge 228 and a second, smaller diameter at an upper edge 232. Such a reduction in diameter is known in the art of manholes and accomplished through an angled cone shaped device as shown here, a stepped cone, an arcuate cone, or other equivalent structures.

Figure 10:
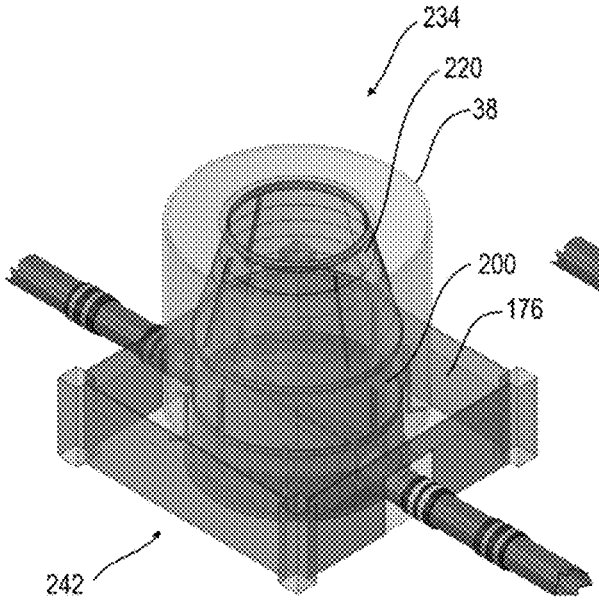
FIG. 10 is a top perspective view of another (e.g. ninth) stage of construction of the manhole rehabilitation system.
Figure 11:
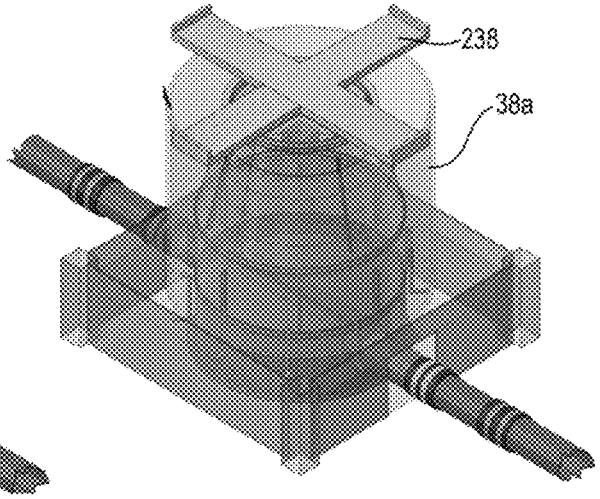
FIG. 11 is a top perspective view of another (e.g. tenth) stage of construction of the manhole rehabilitation system.

Looking to FIG. 10 is shown the shared aggregate 176 forming part of the base assembly 242 with the outer mold 38 positioned thereupon as previously discussed. A riser liner 200 and cone liner 220 are installed as described. This riser liner 200 and cone liner 220 assembly forming the inner surface of a mold 234 into which is poured a volume of aggregate fill 236. As shown in FIG. 11, a worker support 238 functionally equivalent to the worker support 162 may be utilized to allow a worker to correctly and properly form the upper surface 240 of the aggregate fill 236. The aggregate fill being concrete or other materials formed of Portland cement and equivalent pourable materials that harden to a structurally supporting state. The aggregate fill 236 will in one example flow under the channel pipe 123 and thus support the weight of the channel pipe 123 and material flowing therein upon the surface 100. In one example, the sides 161 of the channel form 160 result in a surface of the channel 124 formed of the aggregate fill 166 rising up to or above the edge of the channel pipe 120.

Figure 14:
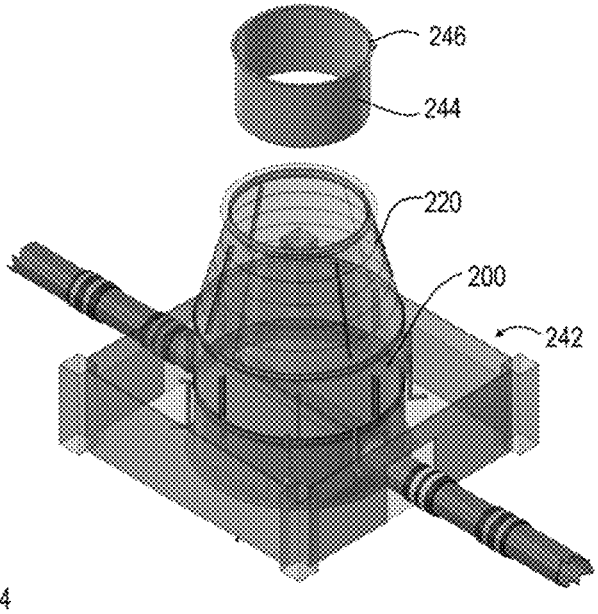
FIG. 14 is a top perspective view of another (e.g. twelfth) stage of construction of the manhole rehabilitation system.
Figure 13:
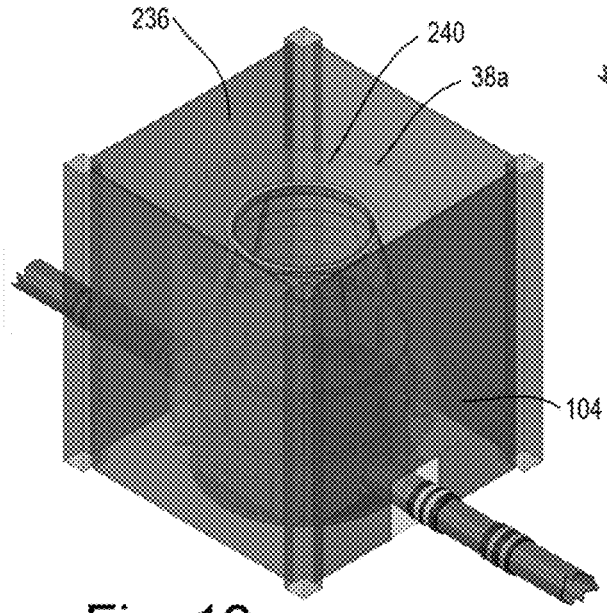
FIG. 13 is a top perspective view of another (e.g. eleventh) stage of construction of the manhole rehabilitation system.

Looking to FIG. 14 is shown the base assembly 242 with the outer mold 38*a* and aggregate fill 236 removed to show the riser liner 200 and cone liner 220. In this example, a telescopic collar tube (TAC) 244 fits inside the cone liner 220 as previously described. The gasket 46 sealing between these components. This TAC having an upper edge 246 which may rest upon the blocks 40 previously discussed in allows the manhole ring 52 to be adjusted to substantially align with the ground level 50.

Figure 15:
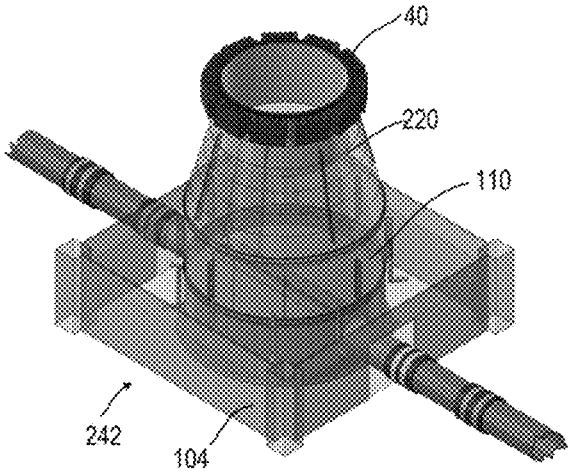
FIG. 15 is a top perspective view of another (e.g. thirteenth) stage of construction of the manhole rehabilitation system.

FIG. 15 shows the blocks 40 in position. It is understood by looking to FIG. 1 that the blocks 40 rest upon the upper surface 248 of the aggregate fill 36 and not on the upper edge of the cone liner 220 in that the cone liner to learn 20 is generally not a structural component.

Figure 16:
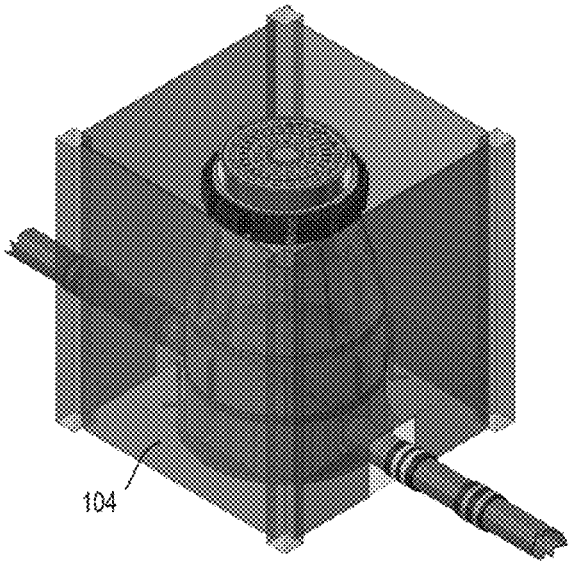
FIG. 16 is a top perspective view of another (e.g. fourteenth) stage of construction of the manhole rehabilitation system.

Looking to FIG. 16 is shown the shoring 104 extending substantially to the ground level 50. Thus, the region between the aggregate fill 36 and the shoring 104 may be filled with a backfill 250. The shoring 104 may then be removed. In another example, the shoring 104 is removed prior to the backfill 250 being placed.

In one example, the base liner 110, riser liner 200, cone liner 220, and collar tube 244 are formed of fiber reinforced plastic (FRP). FRP is well-known in the arts as fiberglass although the term fiberglass is generally synonymous with the fibers used, and thus confusing. An FRP construction is generally a resin impregnated fibrous material; with a hardener added to the resin such that when the combined resin/hardener cures the FRP material hardens to a rigid state. The fibers used may be fiberglass, carbon fiber or less commonly burlap or other materials. The resin may be a polyester resin which is common in the arts, or epoxy which is also common the arts or other partners. They may be one part or two-part although the two-part materials are more common.

One advantage of producing the base liner 110, riser liner 200, cone liner 220, and collar tube 244 from an FRP material is that the same resin may be used as the sealant 214 used between adjoining sections. Thus, the sealant 214 will cure to a hardened state, rigidly securing the adjacent components to each other as a substantially unitary construction.

One installation sequence includes the steps of:

- Excavate and install shoring support. If utilities are found, they should be wrapped with Styrofoam or other protective apparatus.
- Cut existing exterior pipes to the desired length.
- Set base liner on the surface of the excavation.
- Install channel pipe inside base liner extending through pipe openings.
- Cut a channel opening in the channel pipe.
- Connect the channel pipe to the existing exterior pipes.
- Install channel form in the channel opening to keep aggregate and debris out of the channel pipe and to form a deeper concrete channel during grouting.
- Install work platform (worker support).
- Apply adhesive tape to upper edge of base liner to protect joint section from debris.
- Grout inside of base liner with 3250 PSI high flow non-shrink fast set grout and build benching.
- Remove work platform.
- Apply aggregate exterior of base liner.
- Install reinforcing dowels around the outer perimeter of the base liner if required.
- Install inner pouring supports to inner edge of base liner.
- Install one or more riser liners on to base liner using inner pouring supports to ensure alignment.
- Apply resin to the connection between the base liner and the riser liner.
- Install cone liner to the riser liner.
- Apply resin to the connection between the cone liner and the riser liner.
- Install work platform to upper edge of cone liner.
- Apply aggregate exterior of base liner, riser liner, cone liner to upper edge of cone liner.
- Install telescoping access collar to cone liner.
- Install blocks and adhesive to upper surface of aggregate to support manhole ring and manhole cover.
- Install cast iron manhole ring onto blocks.

Apply aggregate to remaining level from the top of cone to rim elevation after telescoping access cone, blocks, cast iron manhole ring are installed and leveled.

Remove the shoring from excavation.

Backfill excavation to rim/ground elevation.

In addition to the steps listed above: these general guidelines should be considered:

Local codes may apply and should be consulted as applicable in manhole installation.

Correct manhole liner installation commonly requires proper connection between segments/components and/or host surface. Good placement of surrounding structural aggregate and proper handling are essential to prevent manhole damage and ensure long-term corrosion resistant service.

FRP manhole liners may be non-structural components. To restore or achieve the desired load rating class of the rehabilitated manhole, the engineer specified grout/aggregate material and optional steel reinforcing should be strictly followed.

In addition to the steps listed above: these general preparation steps should be considered:

Exterior pipes penetrating as-built manhole walls should only be cut with prior consent of engineer or designer.

Cut and remove existing asphalt or concrete.

Excavate and remove flat top or cone section of manhole and remove surrounding material.

Remove all existing ladder rungs, obstacles and debris from existing manhole. Generally, do not cut pipes penetrating as-built manhole walls.

Clean manhole structure walls. Substantially remove all damaged/flaking/unsecured concrete/aggregate materials. This should be accomplished when possible without further damage to manhole structural walls.

Prevent any additional damage to as-built structure or surrounding infrastructure when demolishing and excavating.

If live flow in the exterior piping or manhole, channel should be bypassed.

In low flow applications, "flow thru" inflatable pipe plugs may be acceptable to use as the channel form/plug. If pipe plugs are used, complete blockage of flow will be required for both grouting of base liner and installation of internal pipe seals.

Remove existing interior components (i.e. pumps, grinders, guiderails, valves, etc.)

There should be no flow or process contents in the structure during rehabilitation work on the base. Flow may be restored during construction of Wall Liner segments, provided safety is not compromised.

In addition to the steps listed above: these general baseliner installation steps should be considered:

The channel should be clean and devoid of flow in most applications.

Benching may be partially removed to allow a minimum of 50 mm [2"] (or as specified on project documents) spacing between the base liner and any existing concrete. Care is to be taken when removing the existing benching to prevent damage to the existing base.

The baseliner shall be lowered into position. The liner may be secured in position and fastened with anti-flotation connections to the existing manhole structure. In most applications, the upper edge of the baseliner should be level.

Alignments and level of channels, pipe penetrations and base skirt flange shall be checked. It is commonly recommended to dry fit the baseliner prior to the installation in order to determine the locations of the anti-floatation mountings.

The liner may be connected to existing pipes. Channel of baseliner may be supported during pouring with a matching EPS pouring support.

Pipe penetrations may be sealed with correctly sized inflatable plugs.

Aggregate conforming to specifications of current manhole standards is to be poured into the annular space between the baseliner and any existing structure. Grout may be poured up to 50 mm [2"] below the top of the base liner. Installer should ensure grout is free of voids and air pockets.

Let aggregate set/harden.

Remove mounting brackets and EPS channel support.

After application of aggregate, flow may be temporarily restored with "flow thru" pipe plugs and appropriate length connected hose provide flow does not adversely affect liner cleanliness or worker safety.

For installation of link pipe internal seal, area between as-built pipe and new baseliner must be clear of any/all obstructions.

In addition to the steps listed above: these general wall and cone liner installation steps should be considered:

If base liner component is present, stack riser liner and cone liner segments as needed to fully erect the FRP manhole liner inside an existing manhole. Maintain FRP manhole liner plumb within the manhole throughout the stacking process and ensure that space between the FRP manhole liner and the existing wall is of sufficient thickness throughout the entire circumference, as specified. Establish resin connection between adjoining components.

If base liner component is not present, fully demolish invert and benching to obtain a solid, level aggregate surface at the bottom of the manhole for the first wall liner section. Bond the wall liner to the manhole base with an appropriate sealant, such as Sikaflex®, silicone, or equivalent. Stack remaining riser liner and cone liner components as needed to fully erect the FRP manhole liner inside the existing manhole. Maintain FRP manhole liner plumb within the manhole throughout the stacking process and ensure that space between the FRP manhole liner and the existing wall is of sufficient thickness throughout the entire circumference, as specified by the engineer. Establish resin connection between adjoining components.

If required to restore or achieve the desired load rating class of the rehabilitated manhole, steel reinforcing shall be installed in the annular space between the FRP Manhole liners and the manhole wall, as specified by the engineer.

The FRP manhole liner may be carefully grouted in place, with a high-flow grout/aggregate, from the bottom up, in lifts not exceeding 6'. Aggregate shall be consolidated to fill all pockets, seams and cracks within the existing wall.

If Baseliner component is not present, rebuild invert and bench as specified by the engineer.

In addition to the steps listed above: these general backfill steps should be considered:

Backfilling may be done just as soon as the concrete (grout, aggregate) has hardened enough around the cone liner to provide sufficient support for manhole and fill. Native soil (or sand, in unstable areas), free of large stones, debris, or concrete chunks may be used for backfill. Backfill should be place evenly around manhole in 12" maximum lifts and should be thoroughly tamped to 90% standard proctor density before the next layer is installed. Backfill material shall be subject to approval by the engineer.

In addition to the steps listed above: these general baseliner steps should be considered to bring the final installation to grade:

Construct chimney on flat shoulder of manhole using precast concrete rings (blocks).

Insert FRP telescoping access tube into the gasketed FRP access collar.

Install casting per standard manhole construction methods.

In addition to the steps listed above: these general chela-up steps should be considered:

Upon completion, the installer should clean up the work site and properly dispose of any excess material or debris.

In another installation example:

Exterior Surface:

The exterior surface may be finished with embedded aggregates and FRP bonding bridges to allow for adequate bonding with the surrounding aggregate once installed. The exterior surface should be free of blisters larger than 0.5" in diameter, delamination and fiber show, except in the vicinity of FRP bonding bridges where fiber show may be acceptable. Gel-coat or paint or other coatings may not be allowed.

Interior Surface:

The interior surfaces of the base liner 110, riser liner 200, cone liner 220, and/or collar tube 244 shall be resin rich with no exposed fibers. Interior surface shall be smooth for improved corrosion resistance and reduced sludge build-up. The surface should be free of crazing, delamination, blisters larger than 0.25" in diameter, and wrinkles of 0.125" or greater in depth. Surface pits shall be permitted up to 6/ft2 if they are less than 0.75" in diameter and less than 0.0625" deep. Voids that cannot be broken with finger pressure and that are entirely below the resin surface shall be permitted up to 4/ft2 if they are less than 0.5" in diameter and less than 0.0625" thick. Gel-coat shall be permitted on interior surfaces, no paint or other coatings are allowed.

Chemical Resistance:

FRP lined manholes demonstrate having sufficient corrosion resistance by passing the "Greenbook" 2009 edition (or later), Standard Specifications for Public Works Construction, Chemical Resistance Test (Pickle Jar Test).

Physical Properties:

All FRP liner material shall have the following physical properties when tested at 77° F.±5 degrees:

| Property | Standard | Units | Initial | (Par. VI. F.) |
|---|---|---|---|---|
| Density | ASTM D792 | g/cm3 | 1.02 | |
| Thickness | | Mm | 3 min. | |
| Tensile Strength | ASTM D638 | psi | 7,000 min. | 6,500 min. |
| Hardness (Shore "A") | ASTM D2240 | | 95-97 | 89-97 |
| Weight change | | | | 0.05% max. |
| Flexural Strength | ASTM D790 | Lbf | 124 avg. | |
| Compressive Strength | ASTM D695 | psi | 13,000 | |
| Ignition Loss | ASTM D2584 | % | 52 avg. | |
| Taber abrasion test (weight loss) | ASTM D4060 | % | 0.075 | |

Tensile specimens may be prepared and tested in accordance with ASTM D412 using Die B. Weight change specimens shall be 1 IN by 3 IN samples.

All gaskets may have the following physical properties:

| Property | Standard | Units | Requirement |
|---|---|---|---|
| Chemical resistance: 1N sulfuric acid 1N hydrochloric acid | ASTM D543 (at 24° C. for 48 hr.) | % % | No weight loss No weight loss |
| Tensile Strength | ASTM D412 | psi | 1,200 min. |
| Elongation at Break | ASTM D412 | % | 350 min. |
| Hardness (Shore A) | ASTM D2240 | | ±5 from the connector manufacturer's specified hardness |
| Accelerated oven aging | ASTM D573 (at 70° C. for 7 days) | % | Max 15% decrease in tensile strength; Max 20% decrease in elongation |
| Compression set | ASTM D 395, Method B (at 70° C. for 22 hr.) | % | Max 25% decrease of original deflection |
| Water absorption | ASTM D471 (at 70° C. for 48 hr.) | % | Increase of max 10% of original weight (19 by 25 mm specimen) |
| Ozone Resistance | ASTM D1149 | | Rating 0 |
| Low temperature brittle point | ASTM D2137 | | No fracture at −40° C. |
| Tear resistance | ASTM D624, Die B | kN/m | 34 |

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept. The invention illustratively disclosed herein suitably may be practiced in the absence of any element which is not specifically disclosed herein.

The invention claimed is:

1. A method for producing a manhole comprising the steps of:

establishing an excavation below a ground level;

exposing an external piping in the excavation;

providing a non-structural base structure in a base region of the excavation, the non-structural base structure having pipe openings;

removing a section of the external piping;

placing a channel pipe having opposing ends in the non-structural base structure, and attaching the opposing ends of the channel pipe to the external piping in place of the removed section of external piping, wherein the channel pipe passes through the pipe openings, and wherein the channel pipe has a section thereof removed so as to have an open channel therein forming a fluid conduit to the external piping;

filling at least a portion of the base region with a semi-fluid aggregate material; allowing the aggregate material to harden;

sealing at least one riser liner to an upper edge of the non-structural base structure; and sealing a riser cap to an upper edge of the riser liner.

2. The method as recited in claim 1 wherein the channel pipe is formed of a polymer.

3. The method as recited in claim 1 wherein the open channel is open greater than 170° around a circumference of the channel pipe.

4. The method as recited in claim 1 wherein the step of filling includes the step of filling the non-structural base structure up to an upper edge of the channel pipe.

5. The method as recited in claim 1 wherein the non-structural base structure is formed of fiber reinforced plastic materials (FRP).

6. The method as recited in claim 1 wherein the at least one riser liner is formed of fiber reinforced plastic materials (FRP).

7. The method as recited in claim 1, wherein the non-structural base structure is a base liner.

8. The method as recited in claim 1, wherein the at least one riser liner is non-structural.

9. The method as recited in claim 1, further comprising a step of placing a channel form/plug in the open channel of the channel pipe, substantially sealing the open channel from entry of debris.

10. The method as recited in claim 9, wherein the channel form/plug is sacrificial.

11. The method as recited in claim 1, further comprising a step of disposing a volume of aggregate fill exterior of the non-structural base structure and the at least one riser liner.

* * * * *